US006320485B1

(12) United States Patent
Gruner

(10) Patent No.: US 6,320,485 B1
(45) Date of Patent: Nov. 20, 2001

(54) ELECTROMAGNETIC RELAY ASSEMBLY WITH A LINEAR MOTOR

(76) Inventor: Klaus A. Gruner, 1275 Broadway, Village of Lincolnwood, IL (US) 60014

( * ) Notice: Subject to any disclaimer, the term of this patent is extended or adjusted under 35 U.S.C. 154(b) by 0 days.

(21) Appl. No.: 09/416,988

(22) Filed: Oct. 13, 1999

Related U.S. Application Data

(63) Continuation-in-part of application No. 09/287,469, filed on Apr. 7, 1999, now Pat. No. 6,046,660.

(51) Int. Cl.[7] ..... H01H 51/22
(52) U.S. Cl. ..... 335/78; 335/185; 335/132
(58) Field of Search ..... 335/78–85, 124, 335/128, 185–190, 250, 251, 257, 132

(56) References Cited

U.S. PATENT DOCUMENTS 4,388,535 * 6/1983 Wiktor et al. ..... 307/113
4,430,579 * 2/1984 Wiktor ..... 307/134
6,046,661 * 4/2000 Reger et al. ..... 335/185

* cited by examiner

*Primary Examiner*—Lincoln Donovan
*Assistant Examiner*—Tuyen Nguyen
(74) *Attorney, Agent, or Firm*—Charles F. Meroni, Jr.; Meroni & Meroni, P.C.

(57) ABSTRACT

The present invention is an electromagnetic relay capable of transferring currents of greater than 100 amps for use in regulating the transfer of electricity or in other applications requiring the switching of currents of greater than 100 amps. A relay motor assembly has an elongated coil bobbin with an axially extending cavity therein. An excitation coil is wound around the bobbin. A generally U shaped ferromagnetic frame has a core section disposed in and extending through the axially extending cavity in the elongated coil bobbin. Two contact sections extend generally perpendicularly to the core section and rises above the motor assembly. An actuator assembly is magnetically coupled to the relay motor assembly. The actuator assembly is comprised of an actuator frame operatively coupled to a first and a second generally U-shaped ferromagnetic pole pieces, and a permanent magnet. A contact bridge made of a sheet of conductive material copper is operatively coupled to the actuator assembly.

14 Claims, 4 Drawing Sheets

ELECTROMAGNETIC RELAY ASSEMBLY WITH A LINEAR MOTOR

This application is a Continuation-In-Part application of U.S. patent application Ser. No. 09/287,469 filed on Apr. 7, 1999, now U.S. Pat. No. 6,046,660.

FIELD OF THE INVENTION

The present invention relates to an electromagnetic relay assembly with a linear motor capable of handling current transfers of up to and greater than 100 amps.

DESCRIPTION OF THE PRIOR ART

There are a few designs for electromagnetic relay assemblies currently in the prior art. These electromagnetic relay assemblies typically include a relay motor assembly that is magnetically coupled to an actuation assembly. The actuation assembly is then operatively coupled to a contact spring that is positioned opposite a pair of conductively isolated contact points. The relay motor typically drives the actuation assembly which in turn drives the contact spring into contact with a pair of contact points positioned directly across from it.

The contact springs typically serve a dual purpose. They ensure good contact with the contact points, and they form a conductive pathway between the contact points. Contact springs are typically made of copper or a copper alloy, the copper alloys typically have lower conductivity than plain copper. Plain copper can typically sustain less than 20 amps per square millimeter without causing excess heat build up in the copper. Excess heat build up in the contact springs will cause the contact springs to lose there spring property. This results in a loss of contact pressure which leads to increased contact resistance which in turn causes the relay to fail. Consequently, most electromagnetic relays can only sustain currents of less than 20 amps per square millimeter through their copper contact springs.

In order to increase current density while minimizing the heat generated by higher currents only two options are currently available. One is to make the contact springs wider, requiring an increase in the size of the relay and increasing the bending force needed by the actuator assembly and the relay motor. The other option is to increase the thickness of the spring which will also increase the bending force needed by the actuator assembly and the relay motor. Consequently, typical electromagnetic relays are not-particularly suited for applications which require higher current flows of up to 100 amps.

Also, current relay motors typically have relay motors which generate a rotational movement. Contact springs typically require only a linear movement in the actuator assembly to bring it into contact with the contact points. Consequently additional pieces are required in the actuation assembly in order to convert the rotational movement generated by the relay motor into a linear movement required by most contact springs, adding to the expense of producing and assembling the electromagnetic relay.

Accordingly, there is a need for an electromagnetic relay which is capable of handling currents of up to 100 amps.

Accordingly there is also a need for an electromagnetic relay with a motor that generates a linear movement to accommodate contact assemblies which require only a linear movement.

The present invention is an electromagnetic relay assembly with a linear motor capable of transferring currents of up to 100 amps for use in regulating the transfer of electricity or in other applications requiring the switching of currents of up to 100 amps.

As will be described in greater detail hereinafter, the present invention solves the aforementioned and employs a number of novel features that render it highly advantageous over the prior art.

SUMMARY OF THE INVENTION

Accordingly it is an object of this invention to provide an electromagnetic relay that is capable of safely transferring currents of greater than 100 amps.

A further object of the present invention is to provide an electromagnetic relay with a relay motor that generates a linear movement.

To achieve these objectives, and in accordance with the purposes of the present invention the following electromagnetic relay is presented.

A relay motor assembly has an elongated coil bobbin with an axially extending cavity therein. An excitation coil made of a conductive material, preferably copper is wound around the bobbin. Coil terminals are conductively attached to the excitation coil and mounted on the bobbin providing a means for sending a current through the excitation coil.

A ferromagnetic frame is partially disposed within the axially extending cavity within the bobbin. The ferromagnetic frame has a first contact section with a first tongue portion extending generally perpendicularly from a first contact section and above the bobbin, and a second contact section having a second and third tongue portions extending generally perpendicularly from the second contact section and above the bobbin, the second tongue portion lying below the third tongue portion.

An actuator assembly has a first and second pole piece made of sheets of ferromagnetic material and a permanent magnet sandwiched in between the pole pieces. An actuator frame made of a nonconductive material is operatively coupled to the first and second ferromagnetic pole pieces, and the permanent magnet. The actuator assembly is positioned so that a portion of the first and second pole pieces are located in between the second and third tongue portion on the second contact section and that the first tongue portion of the first contact section is positioned in between the first and second pole pieces. The first and second pole pieces are magnetically coupled to a tongue portion on opposing contact sections.

A lever assembly is comprised of a housing, a plurality of levers, and a plurality of contact arms. The levers are preferably L-shaped levers. The L-shaped levers are rotatably mounted onto a lever attachment point. The L-shaped lever has a first portion and a second portion. The first portion operatively engaged to the actuator frame and the second portion operatively engaged to the side actuator.

A contact bridge assembly is comprised of a plurality of contact springs, preferably 2, a pair of contact buttons, and a contact bridge made of a sheet of conductive material, preferably copper. The contact bridge is operatively coupled to the contact arm. The contact bridge serves as a conductive pathway between a pair of contact points generally positioned across from the contact bridge.

The conductive bridge is connected to the contact spring. The contact spring provides a force on the contact bridge sufficient to ensure good contact between the contact bridge and the contact points lying across from the contact bridge. A pair of contact buttons are also conductively connected to the contact bridge the contact buttons further ensuring that good contact is made between the contact bridge and the two contact points lying across from the contact bridge.

A relay housing encloses the components of the present invention. The relay housing is preferably made of a non-conductive material and has contact terminal assemblies attached thereto and extending through a wall of the relay housing. The contact terminal assemblies typically have isolated contact points positioned across from the contact bridge.

The present invention is driven by the movement of the pole pieces in response to the polarity of a current running through the excitation coil. A linear movement occurs when the polarity of the current running through the excitation coil causes the magnetic flux to induce the first and second pole pieces to magnetically couple to the contact sections opposite the contact section that they were previously magnetically coupled to. This linear movement of the pole pieces drive the movement of the actuator assembly.

The two directional movement of the actuator assembly is then translated by the L-shaped lever onto the side actuator in only one direction. Consequently, the movement of the actuator assembly will either cause the L-shaped lever either to apply a force on the side actuator or else the movement of the actuator assembly will cause the L-shaped lever to apply no force to the side actuator. When the L-shaped lever applies a force onto the side actuator, the side actuator is pulled from its previous position causing the contact bridge to break contact with the contact points positioned opposite to it and compressing the contact springs. When there is no force applied to the contact arm, the contact springs are allowed to decompress, driving the contact bridge into the contact points positioned opposite to it.

Other objects, features, and advantages of the invention will become more readily apparent upon reference to the following description when taken in conjunction with the accompanying drawings.

DESCRIPTION OF THE PREFERRED EMBODIMENT

Figure 1:
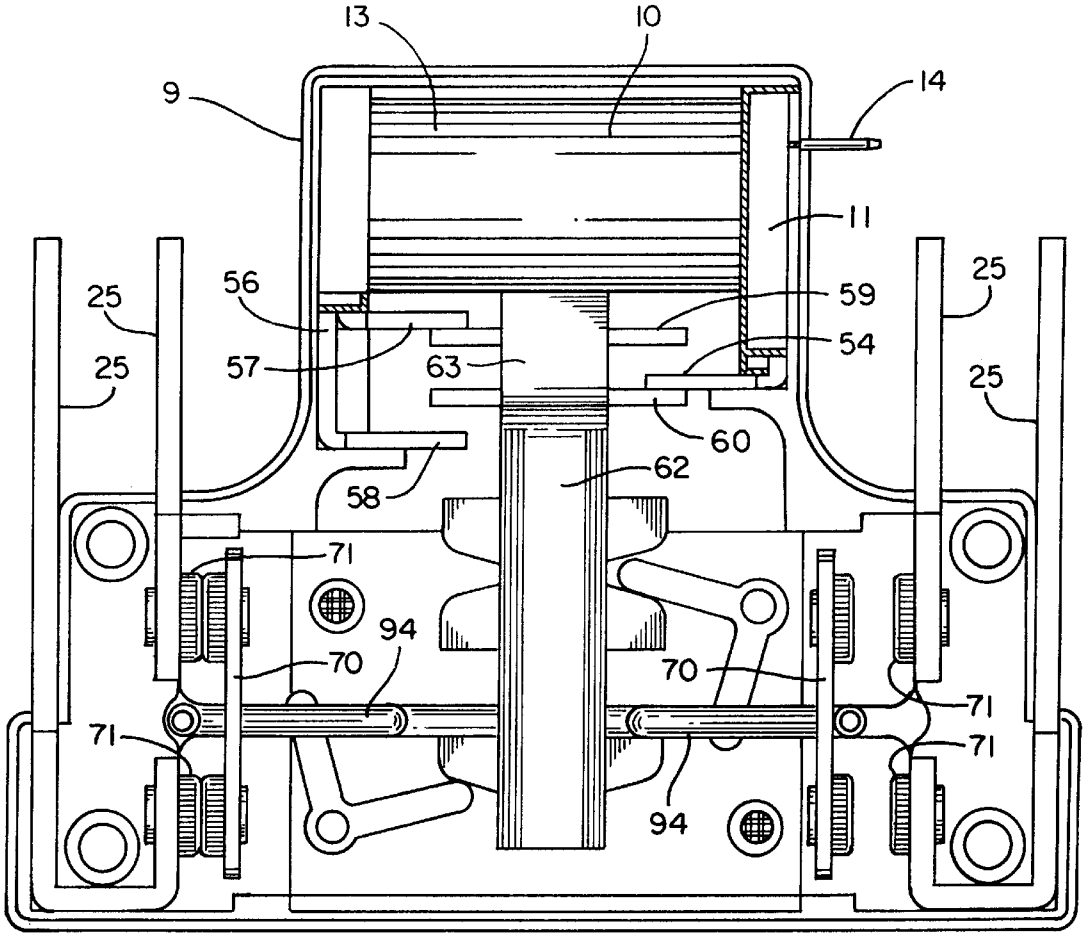
FIG. 1. An overhead planar view of the preferred embodiment of my electromagnetic relay assembly with the upper spring housing removed in order to show details.
Figure 2:
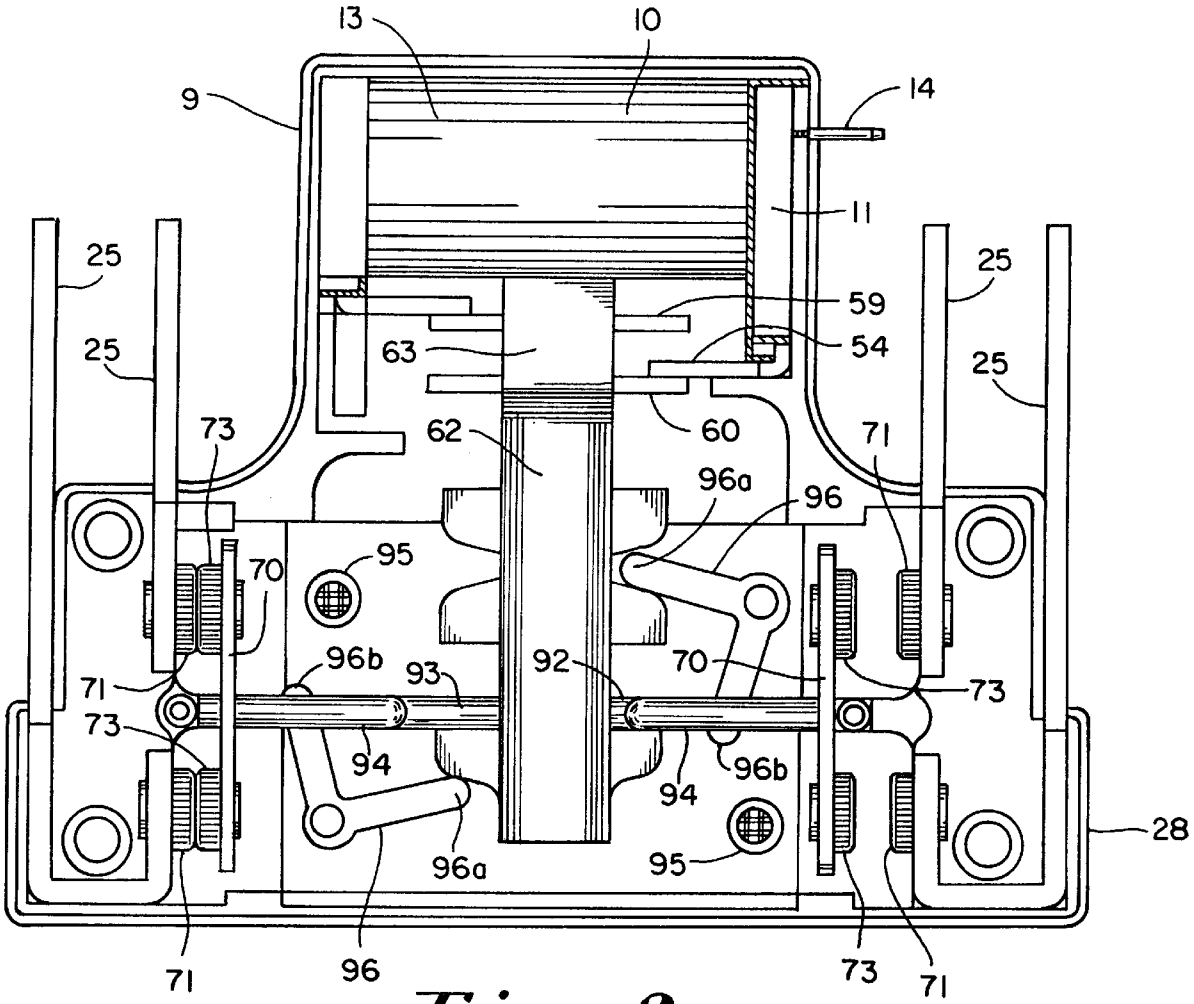
FIG. 2. An overhead planar view of a second embodiment of my electromagnetic relay assembly with upper spring housing removed in order to show details.
Figure 3:
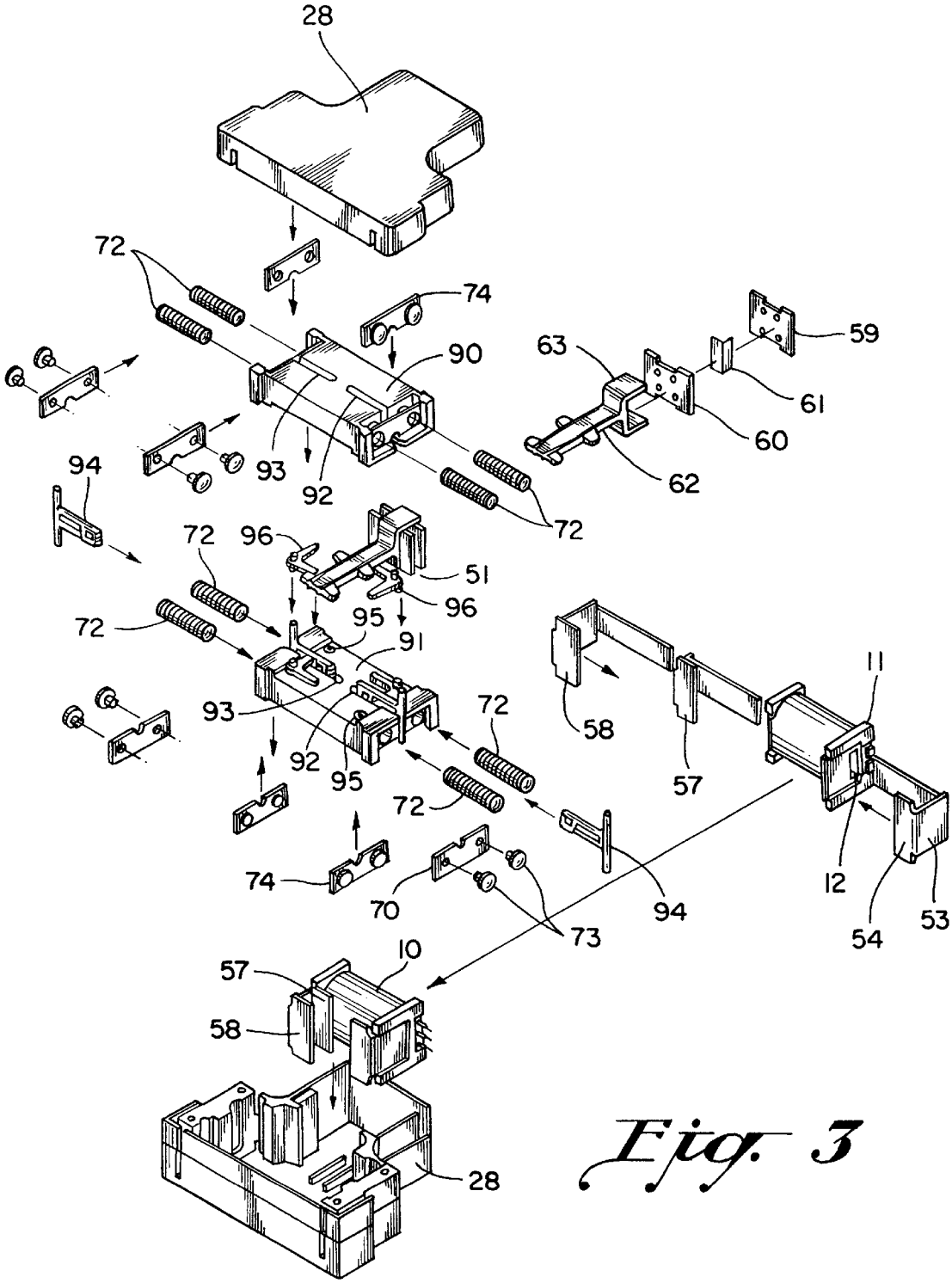
FIG. 3. An exploded view of the preferred embodiment of my electromagnetic relay assembly revealing details.
Figure 4:
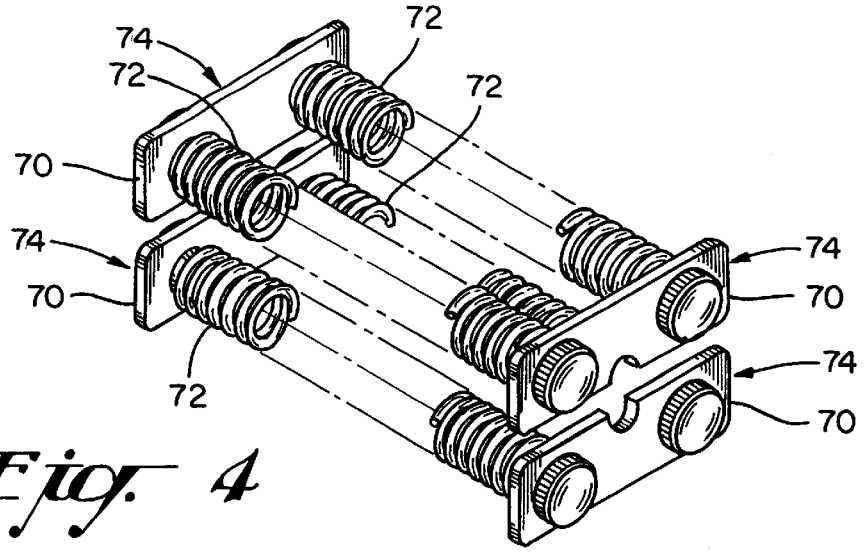
FIG. 4. An isometric view of the contact bridge assembly.

Referring to FIGS. 1,2 and 3, the present invention is an electromagnetic relay 9 capable of transferring currents of greater than 100 amps for use in regulating the transfer of electricity or in other applications requiring the switching of currents of greater than 100 amps.

Referring to FIG. 1 and 3, in the preferred embodiment of the present invention, a relay motor assembly 10 has an elongated coil bobbin 11 with an axially extending cavity 12 therein. The bobbin 11 is made of a light, nonconductive material, preferably plastic. An excitation coil 13 made of a conductive material, preferably copper, is wound around the bobbin. Coil terminals 14 are conductively attached to the excitation coil 13 and mounted on the bobbin providing a means for sending a current through the excitation coil 13.

In the preferred embodiment of a relay motor, a ferromagnetic frame 52 is partially disposed within the axially extending cavity 12 within the bobbin 11 and has a first contact section 53 with a first tongue portion 54 extending generally perpendicularly from a first contact section 53 and above the bobbin 11, and a second contact section 56 having a second 57 and third 58 tongue portions extending generally perpendicularly from the second contact section and above the bobbin 11, the second tongue portion 57 lying below the third tongue portion 58. The ferromagnetic frame can be a single piece or brokers into several different sections so long as continuity is maintained through all the pieces upon assembly.

In the preferred embodiment, an actuator assembly 51 has a first 59 and second pole pieces 60 made of sheets of ferromagnetic material and a permanent magnet 61 sandwiched in between the pole pieces. An actuator frame 62 made of a nonconductive material, preferably plastic is operatively coupled to the first 59 and second 60 ferromagnetic pole pieces, and a permanent magnet 61. In the preferred embodiment, the coupling is achieved through a pair of clip portions 63 which secure the first 59 and second 60 ferromagnetic pole pieces and the permanent magnet 61 to the actuator frame 62.

Referring to FIG. 1,2 and 3, the actuator assembly is positioned so that a portion of the first 59 and second 60 pole pieces are located in between the second 57 and third 58 tongue portion on the second contact section 56 and that the first tongue portion 54 of the first contact section 55 is positioned in between the first 59 and second 60 pole pieces. The first 59 and second 60 pole pieces are magnetically coupled to a tongue portion on opposing contact sections.

Referring to FIG. 2, in a second embodiment, the third tongue portion is removed from the second contact section, leaving only the second tongue portion 57 in place. Since the relay motor will only latch when the first 59 and second 60 pole pieces are magnetically coupled to a tongue portion on opposing contact sections, the removal of the third tongue portion prevents the relay motor from latching in two positions.

Referring to FIGS. 1, 2, and 3, a lever assembly is comprised of a housing, a plurality of levers, and a plurality of side actuators. In the preferred embodiment, the housing is comprised of an upper spring housing 90 and a lower spring housing 91. The upper spring housing 90 overlaying the lower spring housing 91. A first actuator slot 92 and a second actuator slot 93 extends through the upper and lower spring housing. The upper spring housing 90 and the lower spring housing 91 are overlaid so that the first actuator slot 92 and the second actuator slot 93 align. A side actuator is disposed within the first actuator slot 92 and the second actuator slot 93. The lower lever housing has a plurality of attachment points 95 located atop the lower lever housing straddling the first 92 and second 93 actuator slots.

The levers are preferably L-shaped levers 96. The L-shaped levers 96 are rotatably mounted onto a lever attachment point 95. The L-shaped lever 96 has a first portion 96*a* and a second portion 96*b*. The first portion 96*a* operatively engaged to the actuator frame 62 and the second portion operatively engaged to the side actuator 94.

Referring to FIG. 1,2, 3 and 4, in the preferred and second embodiment of the present invention, a contact bridge assembly 74 comprising a plurality of contact springs 72, preferably 2 coiled springs, a pair of contact buttons 73, and a contact bridge 70 made of a sheet of conductive material, preferably copper, is operatively coupled to the side actuator 95. In the preferred embodiment and the second embodiment, a contact bridge assembly is located on opposite ends of both the lower spring housing 91 and the upper spring housing 90.

The contact bridge 70 serves as a conductive pathway between a pair of contact points 71 generally positioned across from the contact bridge 70. The conductive bridge 70 is connected to the contact springs 72. The contact springs 72, are preferably made from steel and are disposed within the upper spring housing 90 or lower spring housing 91. The pressure springs provides a force on the contact bridge sufficient to ensure good contact between the contact bridge and the contact points lying across from the contact bridge. In the second embodiment, the pressure springs also provides a force which drives the actuator assembly back to its starting position. A pair of contact buttons 73 are also conductively connected to the contact bridge 70, the contact buttons 73 further ensuring that good contact is made between the contact bridge and the two contact points 71 lying across from the contact bridge 70.

Since the contact bridge 70 forms the conductive pathway between the two contact points 71 and not the spring 72, the contact bridge can be made thicker and wider to allow for greater current flow, without affecting the properties of the spring. In the preferred embodiment and in the second embodiment of the present invention, the contact bridge is 1 millimeter thick and 10 millimeter wide, allowing the contact bridge to safely handle up to 200 amps without significant heat build up.

Referring to FIGS. 1, 2, and 3, in the preferred embodiment and the second embodiment, a relay housing 28 encloses the components of the present invention. The relay housing 28 is preferably made of a nonconductive material and has contact terminal assemblies 25 attached thereto and extending through a wall of the relay housing 28. The contact terminal assemblies typically have isolated contact points 71 positioned across from the contact bridge 70. An air gap of typically 1.6 mm exists between the contact bridge and each contact point, with the gaps typically adding up to at least 3.0 mm for safe disconnection of power. However, the air gaps can vary to accommodate different applications and different regulatory requirement.

Figure 5:
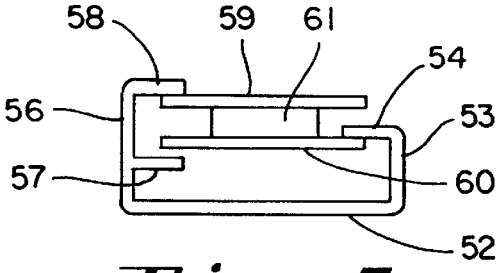
FIG. 5. A side view of the orientation of the pole piece with respect to the ferromagnetic frame in a first position in the preferred embodiment of the present invention.
Figure 6:
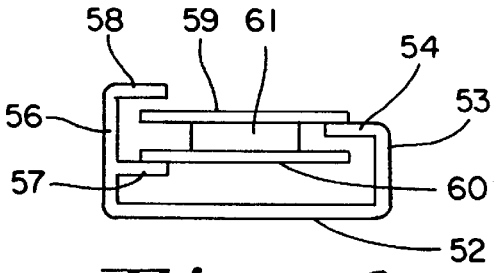
FIG. 6. A side view of the orientation of the pole piece with respect to the ferromagnetic frame in a second position in the preferred embodiment of the present invention.
Figure 7:
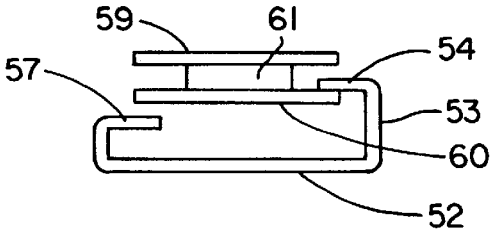
FIG. 7. A side view of the orientation of the pole piece with respect to the ferromagnetic frame in a first position in the second embodiment of the present invention.
Figure 8:
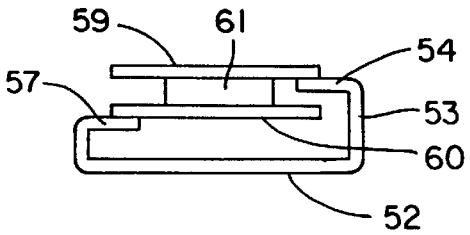
FIG. 8. A side view of the orientation of the pole piece with respect to the ferromagnetic frame in a second position in the second embodiment of the present invention.

The present invention is driven by the movement of the pole pieces 59 and 60 in response to the polarity of a current running through the excitation coil 13. A linear movement occurs when the polarity of the current running through the excitation coil 13, causes the magnetic flux to induce the first 59 and second 60 pole pieces to magnetically couple to the contact sections opposite the contact section that they were previously magnetically coupled to. FIGS. 5 and 6 show the two positions, with respect to the ferromagnetic frame 52, in which the first 59 and second pole pieces 60 of the preferred embodiment linearly reciprocate between. FIGS. 7 and 8 show the two positions, with respect to the ferromagnetic frame 52, in which the first 59 and second 60 pole pieces of the second embodiment of this invention reciprocate between.

In the second embodiment of the relay motor, the relay motor is capable of latching with the actuator assembly in only one position FIG. 8, and capable of temporarily moving to a second position FIG. 7 only as long as the polarity of the current in the relay coil is appropriate. Consequently, when the relay coil is activated to an appropriate polarity, the actuator assembly will move to the second position. Once the polarity in the coil is changed or if their is no current running in the relay coil, the actuator assembly is driven by the contact springs 72, fall back into the first position FIG. 8.

This linear movement of the pole pieces 59, 60 drive the movement of the motor actuator 51. The two directional movement of the actuator motor 51 is then translated by the L-shaped lever 96 onto the side actuator 94 in only one direction. Consequently, the movement of the actuator assembly 51 will either cause the L-shaped lever 96 either to apply a force on the spring 94 or else the movement of the actuator motor 51 will cause the L-shaped lever 96 to apply no force to the side actuator 94. When the L-shaped lever 96 applies a force onto the side actuator 94, the side actuator 94 is pulled from its previous position causing the contact bridge 70 to break contact with the contact points 71 positioned opposite to it and compressing the pressure springs 72. When there is no force applied to the spring, the pressure springs 72 are allowed to decompress, driving the contact bridge into the contact points 71 positioned opposite to it.

The effect of a particular movement by the actuator assembly 51 on the L-shaped lever 96 is dependent upon which attachment point 95 the L-shaped lever 96 is mounted to. Consequently, the present invention is easily configurable. The contact bridge can be easily positioned to be normally open or normally closed with respect to the contact points 71 positioned opposite to it, by simply changing the attachment point 95 of the L-shaped lever 96.

The invention described above is the preferred embodiment of the present invention. It is not intended that the novel device be limited thereby. The preferred embodiment may be susceptible to modifications and variations that are within the scope and fair meaning of the accompanying claims and drawings.

I claim:

1. An electromagnetic relay comprising:

a relay motor comprising a bobbin having an axially extending cavity therethrough and a conductive coil wound therearound, a U-shaped ferromagnetic frame, said U-shaped ferromagnetic frame having a first contact section, a second contact section and a middle section, said middle section disposed in and extending through the axially extending cavity in the bobbin, and said first and said second contact section extending perpendicularly from opposite ends of the core section and rising above the bobbin, the first contact section having a first tongue portion extending perpendicularly from the first contact section and above the bobbin, the second contact section having a second and third tongue portions extending perpendicularly from the second contact section and above the bobbin, the second tongue portion lying below the third tongue portion;

a motor actuator having an actuator frame, the actuator frame having a first side and a second side, the first side having a first cam and a second cam, the second side having a third cam and a fourth cam, the first cam being identical to the third cam, and the second cam being identical to the fourth cam;

a movable contacts assembly, the movable contacts assembly comprising a spring housing, a first L-shaped lever, a second L-shaped lever, a first side-actuator and a second side-actuator, the first L-shaped lever being identical to the second L-shaped lever, both the first L-shaped lever and the second L-shaped lever being symmetrical, the spring housing having a top spring housing and a bottom spring housing, the top spring housing being identical to the bottom spring housing, the top spring housing having a first pivot hole, a second pivot hole, a third pivot hole, a fourth pivot hole, a first actuator slot, a second actuator slot, a first spring cavity, a second spring cavity, a third spring cavity, a fourth spring cavity, the top spring housing being symmetrical across the first slot and the second slot, the bottom spring housing having a fifth pivot hole, a sixth pivot hole, a seventh pivot hole, a eighth pivot hole, a third actuator slot, a fourth actuator slot, a fifth spring cavity, a sixth spring cavity, a seventh spring cavity, a fourth spring cavity, the bottom spring housing being symmetrical across the third slot and the fourth slot, the top spring housing being positioned as a mirror image of the bottom spring housing, the first pivot hole being in line with the seventh pivot, the second pivot being in line with the eighth pivot, the third pivot being in line with the fifth pivot, the fourth pivot being in line with the sixth pivot, the first actuator slot facing the third actuator slot, and the second actuator slot facing the fourth actuator slot, the first L-shaped lever having a first arm with a first end, a second arm with a second end, a first bearing shaft and a second bearing shaft, the first L-shaped lever rotatively positioned with its first shaft in the fourth pivot hole and its second shaft in the sixth pivot hole, the second L-shaped lever having a third arm with a third end, a fourth arm with a fourth end, a third bearing shaft and a fourth bearing shaft, the second L-shaped lever rotatively positioned with its third shaft in the first pivot hole and its fourth shaft in the seventh pivot hole, the first end operatively coupled to the first cam and the third end operatively couple to the fourth cam, or the first L-shaped lever rotatively positioned with its first bearing shaft in the third pivot hole and its second bearing shaft in the fifth pivot hole, the second L-shaped lever rotatively positioned with its third bearing shaft in the second pivot hole and its fourth bearing shaft in the eighth pivot hole, the second end operatively coupled to the second cam and the fourth end operatively couple to the third cam, the first side-actuator having a first lever nesting, a first contact-bridge-arm, and a second contact-bridge-arm, the second side-actuator having a second lever nesting, a third contact-bridge-arm, and a fourth contact-bridge-arm, the first lever nesting operatively coupled to the second end of the first L-shaped lever and the second lever nesting operatively coupled to the fourth end of the second L-shaped lever, or the second lever nesting operatively coupled to the first end of the first L-shaped lever, and the first lever nesting operatively coupled to the third end of the second lever;

a first group of contact bridge assemblies, the first group of contact bridge assemblies having a first contact bridge assembly and a second contact bridge assembly, said first contact bridge assembly having a first contact bridge, a first pressure spring and a second pressure spring, the first pressure spring disposed within the first spring cavity, the second pressure spring disposed within the second spring cavity, both the first pressure spring and the second pressure spring connected to the first contact bridge, the first contact bridge operatively engaged by the first contact-bridge-arm of the first side actuator, the first contact bridge being movable between a first position wherein the first contact bridge not in contact with two first contact points positioned directly opposite the first contact bridge and a second position wherein the first contact bridge in contact with the two first contact points, the first contact bridge serving as a conductive pathway between the two first contact points, the motor actuator acting on the movable contacts assembly, the first cam of the motor actuator driving the first L-shaped lever, the first L-shaped lever driving the first side actuator, the first contact-bridge-arm of the first side actuator pulling the first contact bridge assembly into the first position and compressing both the first pressure spring and the second pressure spring attached thereto, in the second position the first contact-bridge-arm of the first side actuator applying no pulling force allowing both the first pressure spring and the second pressure spring to decompress driving the first contact bridge assembly into contact with the two first contact points, said second contact bridge assembly having a second contact bridge, a third pressure spring and a fourth pressure spring, the third pressure spring disposed within fifth spring cavity, the fourth pressure spring disposed within sixth spring cavity, both the third pressure spring and the fourth pressure spring connected to the second contact bridge, the second contact bridge operatively engaged by the second contact-bridge-arm of the first side actuator, the second contact bridge being movable between a third position wherein the second contact bridge not in contact with two second contact points positioned directly opposite the second contact bridge and a fourth position wherein the second contact bridge in contact with the two second contact points, the second contact bridge serving as a conductive pathway between the two second contact points, the motor actuator acting on the movable contacts assembly, the first cam of the motor actuator driving the first L-shaped lever, the first L-shaped lever driving the first side actuator, the second contact-bridge-arm of the first side actuator pulling the second contact bridge assembly into the third position and compressing both the third pressure spring and the fourth pressure spring attached thereto, in the fourth position the second contact-bridge-arm of the first side actuator applying no pulling force allowing both the third pressure spring and the fourth pressure spring to decompress driving the second contact bridge assembly into contact with the two second contact points; and a second group of contact bridge assemblies, the second group of contact bridge assemblies having a third contact bridge assembly and a fourth contact bridge assembly, said third contact bridge assembly having a third contact bridge, a fifth pressure spring and a sixth pressure spring, the fifth pressure spring disposed within the third spring cavity, the sixth pressure spring disposed within the fourth spring cavity, both the fifth pressure spring and the sixth pressure spring connected to the third contact bridge, the third contact bridge operatively engaged by the third contact-bridge-arm of the second side actuator, the third contact bridge being movable between a fifth position wherein the third contact bridge not in contact with two third contact points positioned directly opposite the third contact bridge and a sixth position wherein the third contact bridge in contact with the two third contact points, the third contact bridge serving as a conductive pathway between the two third contact points, the motor actuator acting on the movable contact s assembly, the second cam of the motor actuator driving the second L-shaped lever, the second L-shaped lever driving the second side actuator, the third contact-bridge-arm of the second side actuator pulling the third contact bridge assembly into the fifth position and compressing both the fifth pressure spring and the sixth pressure spring attached thereto, in the sixth position the third contact-bridge-arm of the second side actuator applying no pulling force allowing both the fifth pressure spring and the sixth pressure spring to decompress driving the third contact bridge assembly into contact with the two third contact points, said fourth contact bridge assembly having a fourth contact bridge, a seventh pressure spring and an eighth pressure spring, the seventh pressure spring disposed within the seventh spring cavity, the eighth pressure spring disposed with the eighth spring cavity, both the seventh pressure spring and the eighth pressure spring connected to the fourth contact bridge, the fourth contact bridge operatively engaged by the fourth contact-bridge-arm of the second side actuator, the fourth contact bridge being movable between a seventh position wherein the fourth contact bridge not in contact with two fourth contact points positioned directly opposite the fourth contact bridge and an eighth position wherein the fourth contact bridge in contact with the two fourth contact points, the fourth contact bridge serving as a conductive pathway between the two fourth contact points, the motor actuator acting on the movable contacts assembly, the second cam of the motor actuator driving the second L-shaped lever, the second L-shaped lever driving the second side actuator the fourth contact-bridge-arm of the second side actuator pulling the fourth contact bridge assembly into the seventh position and compressing both the seventh pressure spring and the eighth pressure spring attached thereto, in the eighth position the fourth contact-bridge-arm of the second side actuator applying no pulling force allowing the seventh pressure spring and eighth pressure spring to decompress driving the fourth contact bridge assembly into contact with the two fourth contact points, the first group of contact bridge assemblies and the second group of contact bridge assemblies together capable of creating double normally open contact arrangements, double normally close contact arrangements, and/or one normally open contact arrangement and one normally close contact arrangement.

2. The electromagnetic relay in claim 1 further comprising a relay housing with a plurality of contact terminal assemblies attached thereto and extending through a wall of the housing, the relay motor, the motor actuator, the movable contacts assembly, the first group of contact bridge assemblies and the second group of contact bridge assemblies being disposed within the housing, the contact terminal assembly having two isolated contact points positioned across the contact bridge, a gap of at least 1.6 mm separating the contact bridge and each contact point.

3. The electromagnetic relay in claim 1 wherein the contact bridge is made of copper and has a width of 10 millimeters and a thickness of 1 millimeter.

4. An electromagnetic relay assembly comprising:

a relay motor;

a motor actuator;

a movable contacts assembly, the movable contacts assembly operatively engaged to the motor actuator, the movable contacts assembly comprising a first and a second L-shaped lever and a first and a second side-actuator, both said first and said second L-shaped lever being symmetrical, both said first and said second L-shaped lever having a first portion with a first end, and a second portion with a second end, the first end operatively engaged to the motor actuator, the side-actuator having a lever nesting, a first contact-bridge-arm, and a second contact-bridge-arm, the lever nesting operatively coupled to the second end of the L-shaped lever; and a first group of contact bridge assemblies, the first group of contact bridge assemblies having a first contact bridge assembly and a second contact bridge assembly, said first contact bridge assembly comprising a first contact bridge and a plurality of pressure springs, the pressure springs connected to the first contact bridge, the first contact bridge operatively engaged by the first contact-bridge-arm of the first side actuator, the first contact bridge being movable between a first position wherein the first contact bridge not in contact with two first contact points positioned directly opposite the first contact bridge, the pressure springs being compressed by the first side actuator, and a second position wherein the first contact bridge in contact with the two first contact points, the pressure springs not being compressed by the first side actuator, the first contact bridge serving as a conductive pathway between the two first contact points, the motor actuator driving the first L-shaped lever, the first L-shaped lever driving the first side actuator, the first contact-bridge-arm of the first side actuator pulling the first contact bridge assembly into the first position and compressing the pressure springs attached thereto, in the second position the first contact-bridge-arm of the first side actuator applying no pulling force allowing the pressure springs to decompress driving the first contact bridge assembly into contact with the two first contact points, said second contact bridge assembly having a second contact bridge and a plurality of pressure springs, the pressure springs connected to the second contact bridge, the second contact bridge operatively engaged by the second contact-bridge-arm of the first side actuator, the second contact bridge being movable between a third position wherein the second contact bridge not in contact with two second contact points positioned directly opposite the second contact bridge, the pressure springs being compressed by the first side actuator, and a fourth position wherein the second contact bridge in contact with the two second contact points, the pressure springs being decompressed by the first side actuator, the second contact bridge serving as a conductive pathway between the two second contact points, the motor actuator driving the first L-shaped lever, the first L-shaped lever driving the first side actuator, the second contact-bridge-arm of the first side actuator pulling the second contact bridge assembly into the third position and compressing the pressure springs attached thereto, in the fourth position the second contact-bridge-arm of the first side actuator applying no pulling force allowing the pressure springs to decompress driving the second contact bridge assembly into contact with the two second contact points; and a second group of contact bridge assemblies, the second group of contact bridge assemblies having a third contact bridge assembly and a fourth contact bridge assembly, said third contact bridge assembly having a third contact bridge and a plurality of pressure springs, the pressure springs connected to the third contact bridge, the third contact bridge operatively engaged by the third contact-bridge-arm of the second side actuator, the third contact bridge being movable between a fifth position wherein the third contact bridge not in contact with two third contact points positioned directly opposite the third contact bridge, the pressure springs being compressed by the second side actuator, and a sixth position wherein the third contact bridge in contact with the two third contact points, the pressure springs being decompressed by the second side actuator the third contact bridge serving as a conductive pathway between the two third contact points, the motor actuator driving the second L-shaped lever, the second L-shaped lever driving the second side actuator, the third contact-bridge-arm of the second side actuator pulling the third contact bridge assembly into the fifth position and compressing the pressure springs attached thereto, in the sixth position the third contact-bridge-arm of the second side actuator applying no pulling force allowing the pressure springs to decompress driving the third contact bridge assembly into contact with the two third contact points, said fourth contact bridge assembly having a fourth contact bridge and a plurality of pressure springs, the pressure springs connected to the fourth contact bridge, the fourth contact bridge operatively engaged by the fourth contact-bridge-arm of the second side actuator, the fourth contact bridge being movable between a seventh position wherein the fourth contact bridge not in contact with two fourth contact points positioned directly opposite the fourth contact bridge, the pressure springs being compressed by the second side actuator, and an eighth position wherein the fourth contact bridge in contact with the two fourth contact points, the pressure springs being decompressed by the second side actuator, the fourth contact bridge serving as a conductive pathway between the two fourth contact points, the motor actuator driving the second L-shaped lever, the second L-shaped lever driving the second side actuator, the fourth contact-bridge-arm of the second side actuator pulling the fourth contact bridge assembly into the seventh position and compressing the pressure springs attached thereto, in the eighth position the fourth contact-bridge-arm of the second side actuator applying no pulling force allowing the pressure springs to decompress driving the fourth contact bridge assembly into contact with the two fourth contact points, the first group of contact bridge assemblies and the second group of contact bridge assemblies together capable of creating double normally open contact arrangements, double normally close contact arrangements, and one normally open contact arrangement and one normally close contact arrangement.

5. The electromagnetic relay in claim 4 wherein the movable contacts assembly is comprised of an upper spring housing and a lower spring housing, a pair of side actuators, and a pair of L-shaped levers, the upper spring housing overlaying the lower spring housing, a first actuator slot and a second actuator slot extending in the upper and lower spring housing, the side actuator disposed within the first actuator slot and the second actuator slot, a bottom side of the L-shaped levers rotatably mounted atop the lower spring housing, each L-shaped lever operatively engaged to a side actuator, the lower and upper spring housing each having a pair of contact bridge assemblies attached thereto, each side actuator operatively engaging a contact bridge on the upper spring housing and a contact bridge on the lower spring housing.

6. The electromagnetic relay in claim 4 wherein the movable contacts assembly is comprised of a housing, an L-shaped lever and a side actuator, the housing having a plurality of actuator slots and a plurality of lever attachment points alongside the actuator slots, the L-shaped lever rotatively mounted onto a lever attachment point, the L-shaped lever having a first portion and a second portion, the first portion operatively engaged to the motor actuator and the second portion operatively engaged to the side actuator, the side actuator disposed within the channel.

7. The electromagnetic relay in claim 4 wherein further comprising a housing with a plurality of contact terminal assemblies attached thereto and extending through a wall of the housing, the relay motor, the motor actuator, the movable contacts assembly and a plurality of the contact bridge assemblies being disposed within the housing, the contact terminal assembly having two isolated contact points positioned across the contact bridge, a gap of at least 1.6 mm separating the contact bridge and each contact point.

8. The electromagnetic relay in claim 4 wherein the contact bridge is made of copper and has a width of 10 millimeters and a thickness of 1 millimeter.

9. An electromagnetic relay assembly comprising:

a relay motor;

a motor actuator having an actuator frame, the actuator frame having a first side and a second side, the first side having a first cam and a second cam, the second side having a third cam and a fourth cam, the first cam being identical to the third cam, and the second cam being identical to the fourth cam;

a movable contacts assembly, the movable contacts assembly comprising a housing, a first L-shaped lever, a second L-shaped lever, a first side actuator and a second side-actuator, the first L-shaped lever being identical to the second L-shaped lever, both the first L-shaped lever and the second L-shaped lever being symmetrical, the housing having a plurality of lever attachment points, a first actuator slot and a second actuator slot, both the L-shaped lever rotatively mounted onto a lever attachment point, the first L-shaped lever having a first portion with a first end and a second portion with a second end, the second L-shaped lever having a third portion with a third end and a fourth portion with a fourth end, the first portion operatively engaged to either the first cam or second cam of the motor actuator and the second portion operatively engaged to the first lever-nesting of the first side-actuator, the third portion operatively engaged to either the third cam or the fourth cam of the motor actuator and the fourth portion operatively engaged to the second lever-nesting of the second side-actuator, the first side-actuator disposed within the first actuator slot and the second side-actuator disposed within the second actuator slot; and a contact bridge assembly, the contact bridge assembly comprising a contact bridge and a plurality of pressure springs, the pressure spring disposed within the housing and connected to the contact bridge, the contact bridge operatively engaged by the either the first side actuator or the second side actuator, the contact bridge being movable between a first position wherein the contact bridge not in contact with two contact points positioned directly opposite the contact bridge and a second position wherein the contact bridge in contact with the contact points, the contact bridge serving as a conductive pathway between the two contact points, the motor actuator acting on both said first L-shaped lever and said second L-shaped lever, said first L-shaped lever driving said first side actuator and said second L-shaped lever driving said second side actuator, either the first side actuator or the second side actuator pulling the contact bridge assembly into the first position and compressing the pressure springs attached thereto, in the second position the side actuator applying no pulling force allowing the pressure springs to decompress driving the contact bridge assembly into contact with the two contact points.

10. The electromagnetic relay in claim 9 wherein the movable contacts assembly is comprised of an upper string housing and a lower spring housing, a pair of side actuators, and a pair of L-shaped levers, the upper spring housing overlaying the lower spring housing, a first actuator slot and a second actuator slot within the upper and lower spring housing, a side actuator disposed within the first and the second actuator slot, the L-shaped levers rotatably mounted onto a lever attachment point located atop the lower spring housing each L-shaped lever operatively engaged to a side actuator, the lower and upper spring housing each having a pair of contact bridge assemblies attached thereto, each side actuator operatively engaging a contact bridge on the upper spring housing and a contact bridge on the lower spring housing.

11. The electromagnetic relay in claim 9 wherein further comprising a housing with a plurality of contact terminal assemblies attached thereto and extending through a wall of the housing, the relay motor, the motor actuator, the movable contact assembly and a plurality of the contact bridges being disposed within the housing, the contact terminal assembly having two isolated contact points positioned across the contact bridge, a gap of at least 1.6 mm separating the contact bridge and each contact point.

12. The electromagnetic relay in claim 9 wherein the contact bridge is made of copper and has a width of 10 millimeters and a thickness of 1 millimeter.

13. An electromagnetic relay assembly comprising:

a ready motor comprising a bobbin having an axially extending cavity therethrough and a conductive coil wound therearound, a U-shaped ferromagnetic frame, said U-shaped ferromagnetic frame having a first contact section, a second contact section and a plurality of core sections, said plurality of core sections disposed in and extending through the axially extending cavity in the bobbin, said first and second contact section extending perpendicularly from opposite ends of the core section and rising above the bobbin, the first contact section having a first tongue portion extending perpendicularly from the first contact section and above the bobbin, the second contact section having a second and portion extending perpendicularly from the second contact section and above the bobbin;

means for conductive contact, the means for conductive contact coupled to the relay motor; and an actuator assembly, the actuator assembly operatively engaged to the means for conductive contact by way of a movable contacts assembly, the movable contacts assembly comprising a housing, an L-shaped lever and a side actuator, the housing having a plurality of lever attachment points and a plurality of actuator slots, the L-shaped lever rotatively mounted onto a lever attachment point, the L-shaped lever having a first portion and a second portion, the first portion operatively engaged to the actuator assembly and the second portion operatively engaged to the side actuator, the side actuator disposed within the actuator slot and operatively coupled to the means for conductive contact, said means for conductive contact being driven by said side actuator, said side actuator being driven by said L-shaped lever, said L-shaped lever being driven by said actuator assembly.

14. The electromagnetic relay in claim 13 wherein the means for conductive contact is a contact bridge assembly, the contact bridge assembly comprising a contact bridge and a plurality of contact springs.

* * * * *